US005826843A

United States Patent [19]

Sturm

[11] Patent Number: 5,826,843

[45] Date of Patent: Oct. 27, 1998

[54] BANANA HANGER

[76] Inventor: Michael O. Sturm, 10849 NW. 103rd Ct., Granger, Iowa 50109

[21] Appl. No.: 822,799

[22] Filed: Mar. 24, 1997

[51] Int. Cl.[6] ..... F16M 11/00

[52] U.S. Cl. ..... 248/176.1; D7/602; 211/13.1; 248/175

[58] Field of Search ..... 248/121, 122.1, 248/175, 176.1; D7/638, 601, 602; 211/13

[56] References Cited

U.S. PATENT DOCUMENTS

| | | | |
|---|---|---|---|
| D. 245,835 | 9/1977 | Lusk et al. . | |
| 249,125 | 11/1881 | Vossler | 248/176.1 |
| D. 290,558 | 6/1987 | Zorrilla . | |
| D. 300,790 | 4/1989 | Beckwith . | |
| D. 356,906 | 4/1995 | Dardashti et al. . | |
| D. 367,153 | 2/1996 | Sturm . | |
| 1,211,926 | 1/1917 | Dodd | 248/121 X |
| 1,229,349 | 6/1917 | Timberlake | 248/175 X |
| 1,715,603 | 6/1929 | Kamman | 211/85.4 |
| 2,521,355 | 9/1950 | Ford | 248/121 X |
| 2,926,875 | 3/1960 | Hoye | 248/121 |
| 3,079,724 | 3/1963 | Harvel et al. | 248/175 X |
| 3,335,870 | 8/1967 | Hills | 248/121 X |
| 4,131,079 | 12/1978 | Rousseau, Jr. et al. | 248/121 X |
| 4,936,466 | 6/1990 | Nava | 248/176.1 X |
| 5,064,154 | 11/1991 | Payne | 248/121 |

OTHER PUBLICATIONS

Reliance Trading Corporation of America; Model 01806. (photograph).

*Primary Examiner*—Leslie A. Braun
*Assistant Examiner*—Derek J. Berger
*Attorney, Agent, or Firm*—Henderson & Sturm

[57] ABSTRACT

A banana hanger which has a base member with a hole therethrough, the base having a top and a bottom. A hollow banana, for example, made of plastic or wood is provided and has an opening in the top and the bottom thereof. A rod extends through the banana, the rod having a banana hanging hook on the top end thereof, outside of the banana, and a bottom end, outside the banana, disposed in the hole in the base for holding the banana hanging rod and artificial banana in a desired position.

6 Claims, 5 Drawing Sheets

BANANA HANGER

CROSS-REFERENCE TO RELATED APPLICATIONS

A design application is also being filed to this invention.

STATEMENT REGARDING FEDERALLY SPONSORED RESEARCH OR DEVELOPMENT

Not Applicable

BACKGROUND OF THE INVENTION

1. Field of the Invention

The present invention relates generally to banana hangers and more particularly to a banana hanger having a rod extending through a hollow banana, the rod having a hook on the top for holding bananas and a bottom part of the rod attached to a base for holding the banana hanger in a proper position.

2. Description of the Related Art

U.S. Pat. Nos. Des. 245,835, Des. 290,558, Des. 300,790 and Des. 356,906 show the general concept of using a hanger for bananas to keep them fresh and to permit the ripening process to be consistent to all of the bananas. It also makes a nicer presentation of such bananas and keeps them in sight so they do not become too ripe while laying on a counter or the like and while not being noticed.

U.S. Pat. No. Des. 367,153 shows the concept of using an upright portion which is actually the shape of a banana so that part of the banana holder looks like it is one of the bananas in the group and creates the illusion that the bananas are suspended in air with no visual indication of how they are being so held.

One of the problems associated with the last mentioned patent device is the one of how to construct it so that the banana will be properly held with respect to the base. This is true regardless of the construction of the artificial banana member itself; i.e. whether it is made of plastic, wood, or whatever. Accordingly, there is a need for a method of constructing a banana hanger which will overcome the aforementioned problem.

Those concerned with these and other problems recognize the need for an improved banana hanger.

BRIEF SUMMARY OF THE INVENTION

The present invention relates to a banana hanger which has a base member with a hole therethrough, the base having a top and a bottom. A hollow banana, for example, made of plastic or wood is provided and has an opening in the top and the bottom thereof A rod extends through the banana, the rod having a banana hanging hook on the top end thereof, outside of the banana, and a bottom end outside the banana disposed in the hole in the base for holding the banana hanging rod and artificial banana in a desired position.

The invention also relates to a method of making a banana hanger from an artificial banana by forming a base member and forming a hole in each end of such hollow imitation banana. A rod is then bent to a curved shape to fit through the banana and is bent to have a hook on the top thereof The rod is then threaded through holes in the top and bottom of the artificial banana. Then the bottom end of the rod, which extends out through the bottom of the artificial banana, is bent to a position so that when the bottom end of the rod is connected to the base, the hollow imitation banana and rod will be in a proper position for holding a bunch of bananas.

A further aspect of the present invention can include the step of putting threads on the bottom end of the rod and having a threaded fastener under the base so that the threaded rod can be threadably attached to the threaded fastener to pull the bottom of the artificial banana against the base and prevent the artificial banana from being loose with respect to the rod and base.

An object of the present invention is to provide an improved banana hanger.

Another object of the present invention is to provide a method of producing a banana hanger from a hollow banana in such a way as to keep the artificial banana from rattling on a supporting rod and to keep it substantially integral with the rod and the base thereof.

Other objects, advantages, and novel features of the present invention will become apparent from the following detailed description of the invention when considered in conjunction with the accompanying drawings.

DETAILED DESCRIPTION OF THE INVENTION

Figure 1:
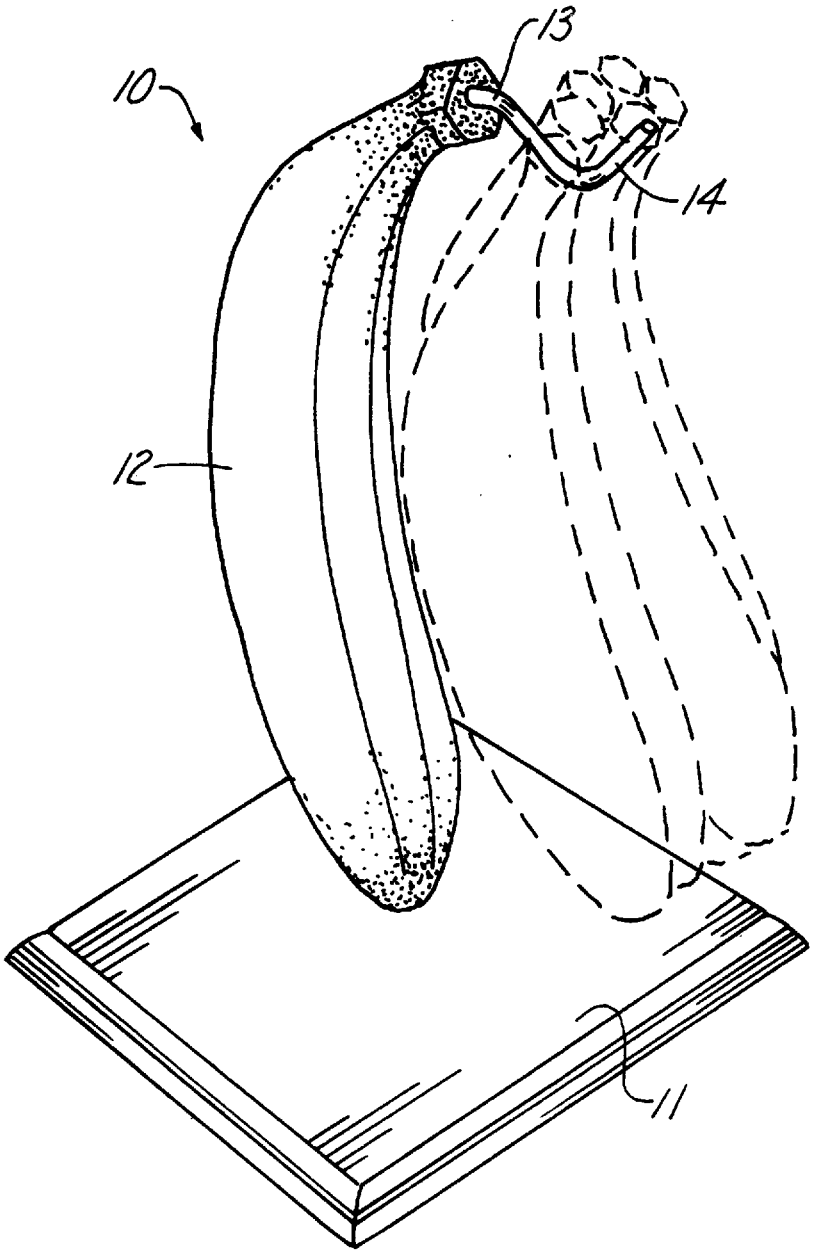
FIG. 1 is a perspective view of a banana hanger constructed in accordance with the present invention and showing in dashed lines a bunch of bananas to be consumed and how they will hang on the banana hanger.

Referring now to the drawings, wherein like reference numerals designate identical or corresponding parts throughout the several views, FIG. 1 shows a banana hanger (10) constructed in accordance with the present invention and having a base (11) which is preferably constructed of wood and a plastic banana (12) which has been previously blow-molded. The banana (12) could also be constructed of wood or other materials if desired. For example, many artificial bananas are constructed of a papiermache-like material.

A rod (13) is shown extending from the top end of the banana (12) and this rod (13) has a hook (13A) on the top end thereof.

Figure 2:
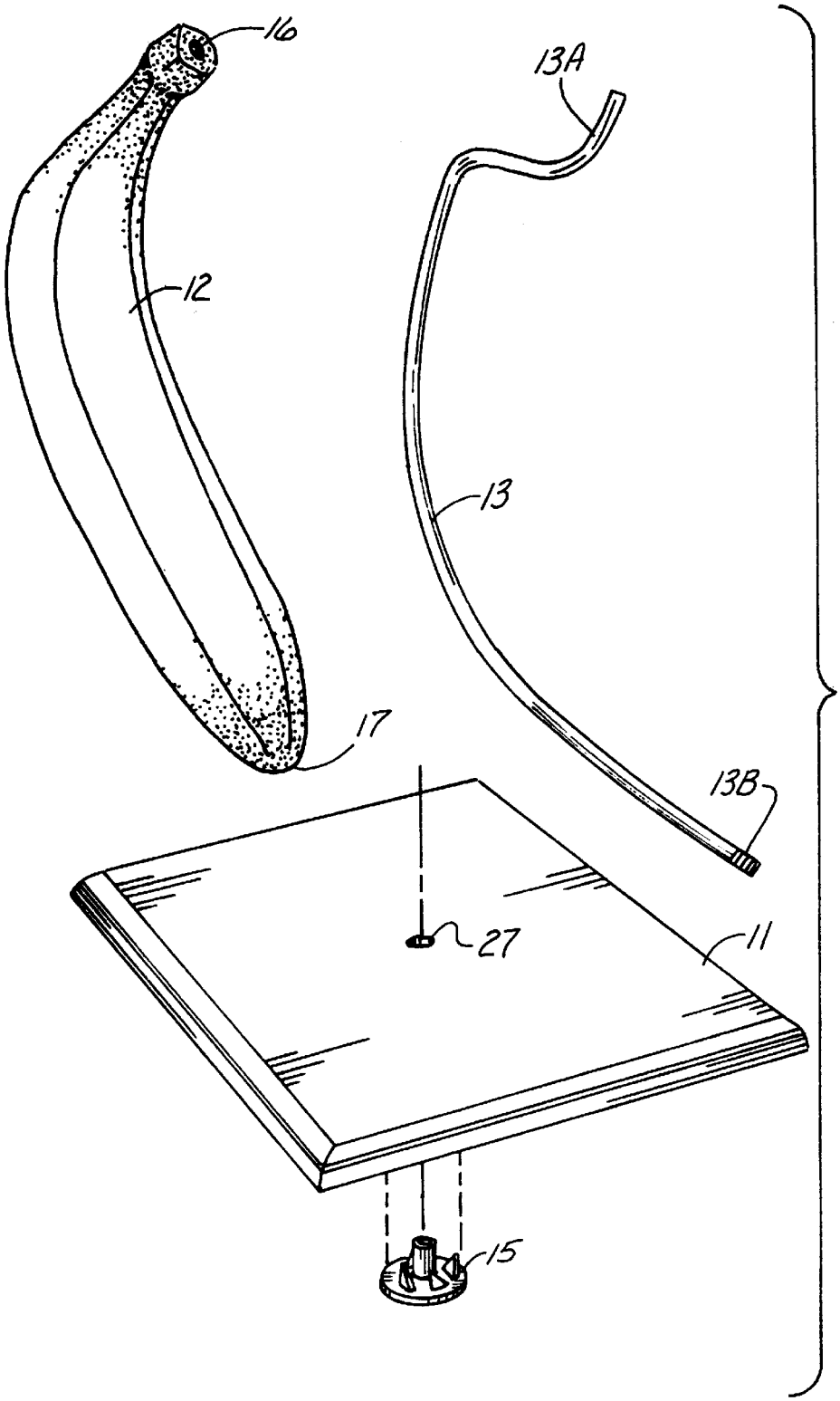
FIG. 2 is an exploded view of the parts of the banana hanger of FIG. 1.

Referring now to FIG. 2, the rod (13) is shown with a bottom portion (13B) which is threaded to be threadably engaged at an appropriate time to T-nut (15) which fits in an opening in the bottom of the base (11) as will be explained below.

The method of construction of the banana holder of FIG. 1 is to drill a hole (16) in the top of the banana (12) and drill a hole (not shown) at the bottom (17) of the plastic banana (12).

A rod (13) is bent to the shape shown in FIG. 2 and this includes bending the hook portion (13A) at the top; and, if desired, by threading the bottom with threads (14).

Figure 7:
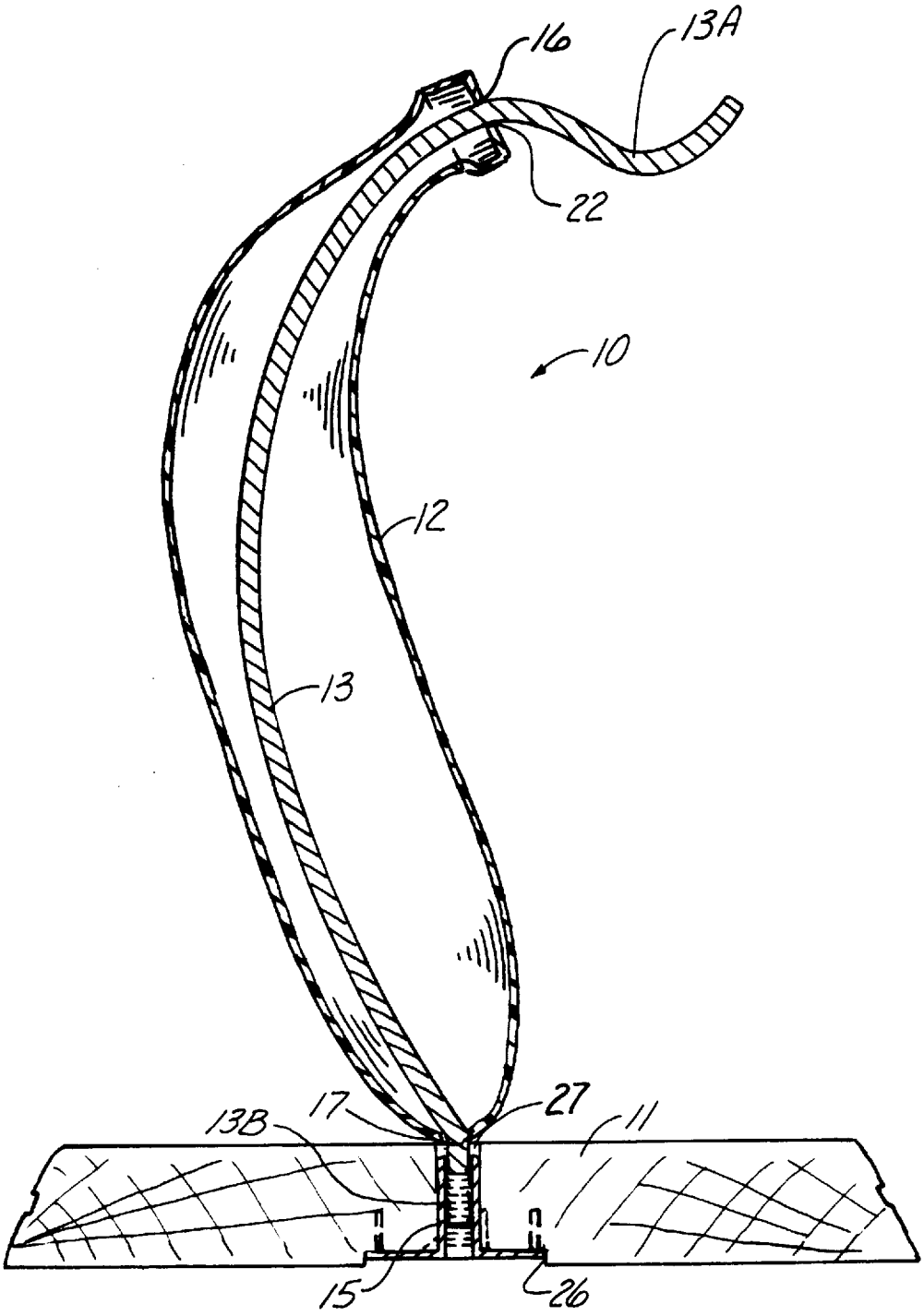
FIG. 7 shows the final assembly in cross-section of the banana holder of the present invention produced by the method of the present invention.

Referring to FIG. 7, a wooden base (11) is provided, being understood that the base (11) could be constructed of other materials if desired. A hole (27) and a countersunk portion (26) is drilled into the base (11). This allows the T-nut (15) to be driven up through the bottom so that it will eventually be in the position shown in FIG. 7.

Figure 3:
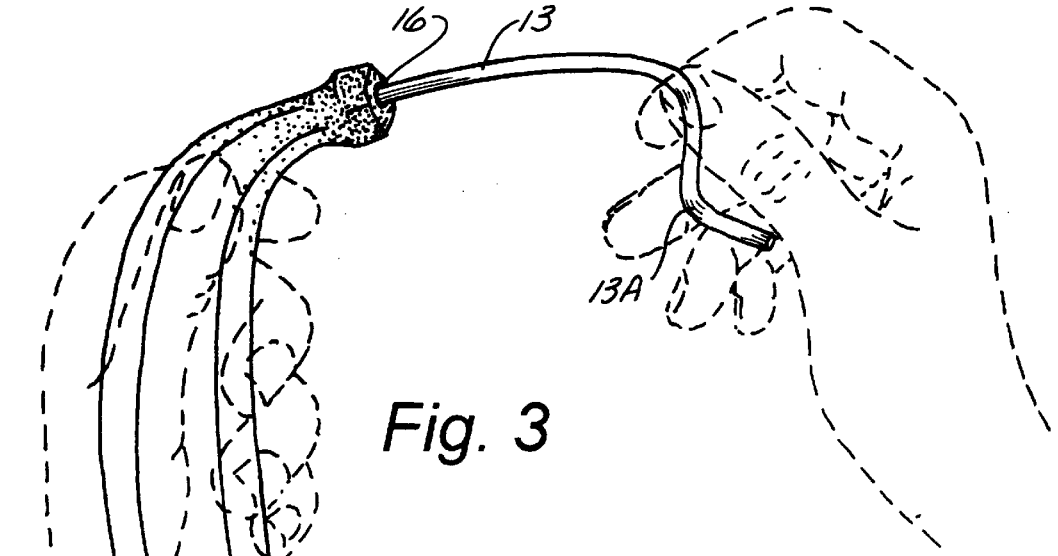
FIG. 3 shows how the rod is threaded through a plastic artificial banana at the beginning.
Figure 4:
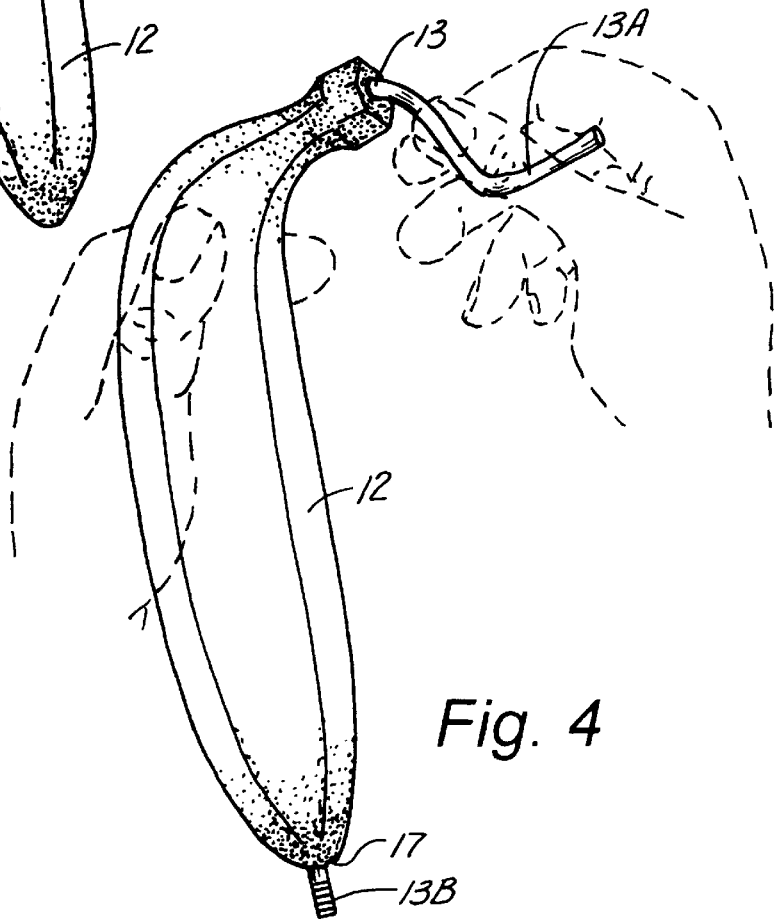
FIG. 4 shows the final step of the threading of the rod through the banana.

Referring now to FIGS. 3 and 4, the rod (13) is threaded through the hollow banana (12) by first starting it through the top hole (16) and eventually having it pass through the bottom hole (17) so that it is in the position shown in FIG. 4 with the threaded bottom end (13B) extending through the bottom of the plastic banana (12).

Figure 5:
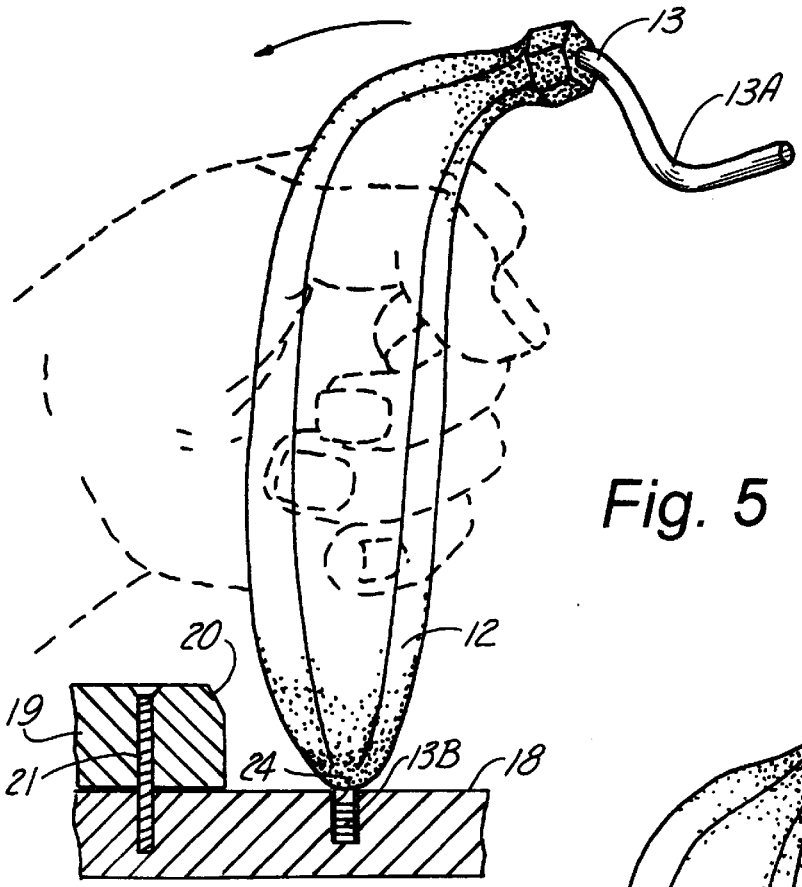
FIG. 5 shows a placing the assembly of FIG. 4 in a jig for bending the rod from the position shown in FIG. 5 to the position shown in FIG. 6 with a stop to prevent over bending.

Once this has been accomplished, the assembly shown in FIGS. 3 and 4 are moved to a jig (18) which has a stop portion (19) thereon with a contact portion (20). A threaded fastener (21) attaches the base (18) to the stop (19). The assembly shown in FIG. 4 is then pulled from the position shown in FIG. 5 to the position shown in FIG. 6 until the banana (12) is in the position shown in FIG. 6 where it contacts the stop (20). That will be the proper amount of bending to the lower portion (13B) of the rod (13). It has been determined that for some materials, such as a preferred material of brass, that is important that this bend be done above the threads (14), otherwise a brass rod will snap off at the threads because it has been weakened to some extent by the threading process. The hole (24) in member (18) is approximately the same size or ever so slightly larger than the diameter of the rod (13).

Figure 6:
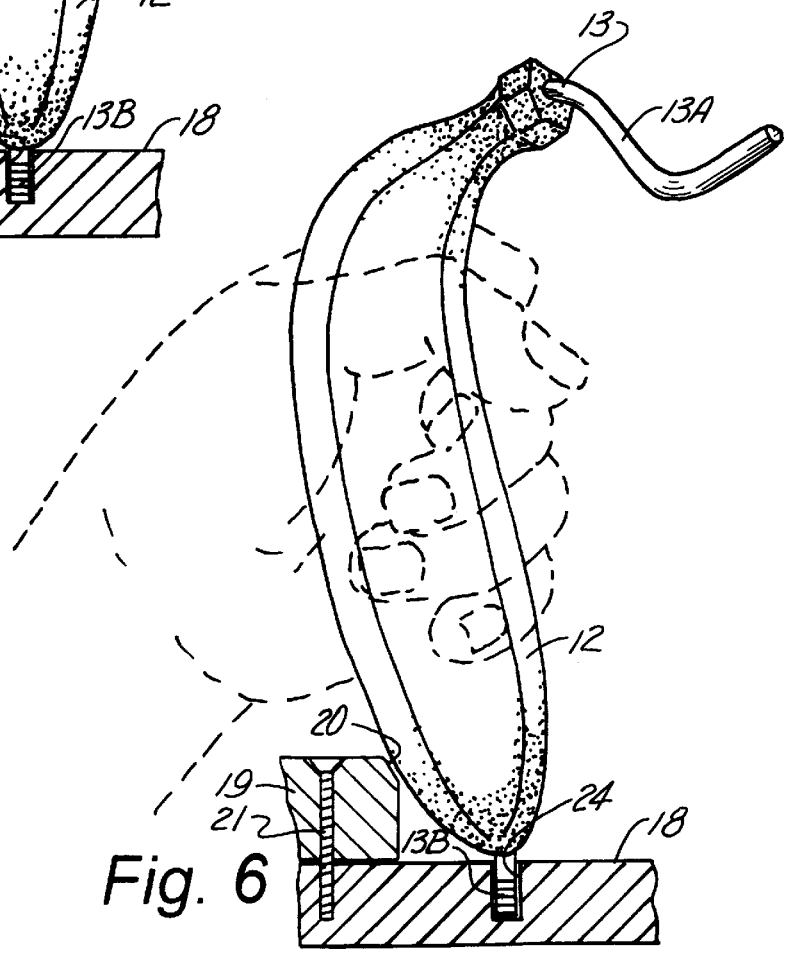

Once the assembly shown in FIG. 6 has been produced, it can be packaged with a base (11) with the T-nut (15) attached thereto as shown in FIG. 7 and easily shipped from place to place. When the consumer actually takes the assembly of FIG. 6, less the bending jig, out of the box and takes the base (11), as shown in FIG. 7, out of the box, the consumer can readily engage the threads (14) with the threads of T-nut (15.) It will be constructed with threads so that the bottom of the banana (17) will engage the top of the base (11) and at the same time pull from the top of the banana (12) at point (22) shown in FIG. 7 to pull the plastic banana (12) down against the top of the base (11), thereby causing the banana (12) to be tight against the top of the base (11). This will also prevent the plastic banana (12) from wobbling on the rod (13). This creates a very unitary structure so that the plastic banana (12), the rod (13) and the base (11) appear to be tight and integral with respect to each other. Very little movement will occur once it is so assembled.

If course it is to be understood that the invention will work if the banana (12) is somewhat loose on the rod (13), which would allow movement of the banana (12) with respect to the rod (13) and base (11). But, in its preferred embodiment, it is desired that this above referred to tightness and lack of relative movement between the rod (13), banana (12) and base (11)is desired. Of course, just because of the fact that the plastic banana (12) will bend, it can be twisted to some extent to move it on the rod (13) and be movable with respect to the rod (13) and base (11). This still constitutes an acceptable construction.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A method of making a banana hanger comprising:

forming a base member having a top and a bottom;

forming a hole in each end of a hollow imitation banana said banana having a top end and a bottom end;

bending a rod to a curved shape and to have a hook on a top end thereof;

threading the rod through said holes and through the banana;

bending a bottom end of the rod when the banana hanger is assembled; and connecting the bottom end of the rod to the base.

2. The method of claim 1 including a step of putting threading on the bottom end of the rod.

3. The method of claim 2 wherein the step of connecting the bottom end of the rod to the base includes:

forming a hole through the base, said hole having a top and a bottom;

placing a threaded fastener on the bottom of the hole;

putting the bottom end of the rod through the hole in the base; and engaging the threading of the bottom end of the rod with the threads of said threaded fastener.

4. The method of claim 3 including pulling the rod and thereby the banana toward the base by rotating the rod with respect to the threaded fastener until the bottom end of the banana tightly against the top of the base thereby holding the banana from being loose on said rod.

5. The method of claim 1 wherein the step of bending the bottom of the rod includes bending the bottom end of the rod includes while the rod is extending through the banana but before connecting the rod to the base.

6. A banana hanger comprising:

a base member having a hole therethrough, said base having a top and a bottom;

a hollow imitation banana said banana having a top and a bottom end having an opening in the top and an opening in the bottom;

a rod having a curved portion extending through said banana, said rod having a banana and top and bottom ends extending through said openings in the top and bottom of the banana, hanging hook on the top end thereof outside of the banana, said bottom end being disposed in said hole in the base.

* * * * *

UNITED STATES PATENT AND TRADEMARK OFFICE

CERTIFICATE OF CORRECTION

PATENT NO. : 5,826,843
DATED : October 27, 1998
INVENTOR(S) : Michael O. Sturm

It is certified that error appears in the above-identified patent and that said Letters Patent is hereby corrected as shown below:

Columns 3 and 4, delete line numbers "15,20,25,30,35,40,50,and 55"

because they are all incorrectly positioned.

Column 4, lines 19 and 20: delete "when the banana hanger is assembled".

Column 4, line 36: after "banana" insert --is disposed--.

Column 4, line 40: delete "includes".

Column 4, lines 49-51: delete "and top and bottom ends extending through said openings in the top and bottom of the banana,".

Column 4, line 49: after "banana," (first occurrence) insert --and top and bottom ends extending through said openings in the top and bottom of the banana--.

Signed and Sealed this
Twenty-fifth Day of May, 1999

*Attest:*

Q. TODD DICKINSON

*Attesting Officer*

*Acting Commissioner of Patents and Trademarks*